US006394320B1

(12) United States Patent
Feiman

(10) Patent No.: US 6,394,320 B1
(45) Date of Patent: May 28, 2002

(54) DISPOSABLE PACKAGING DEVICE THAT DISPENSES CONTENTS BY MOUTH/ BREATH, WITH FRONT-END LOADING, A BUILT-IN BARRIER TO INSURE CONTENTS ARE DISPENSED ONLY IN APPROPRIATE DIRECTION, AND TEAR-AWAY SECTIONS OF THE MOUTHPIECE

(76) Inventor: Vladimir Feiman, 9527 SW. 1st Ct., Coral Springs, FL (US) 33071

( * ) Notice: Subject to any disclaimer, the term of this patent is extended or adjusted under 35 U.S.C. 154(b) by 0 days.

(21) Appl. No.: 09/934,129

(22) Filed: Aug. 22, 2001

(51) Int. Cl.[7] ..... F41B 1/00
(52) U.S. Cl. ..... 222/394; 222/335; 124/62
(58) Field of Search ..... 222/394, 335; 124/62; 446/475

(56) References Cited

U.S. PATENT DOCUMENTS 921,764 A * 5/1909 Wheeler ..... 124/62
1,491,809 A 12/1924 Macchia ..... 124/62
2,512,313 A * 6/1950 Dritz ..... 124/62
2,679,838 A 6/1954 Thompson ..... 124/62
4,646,762 A 3/1987 Riehl
5,624,295 A 4/1997 Watkins
5,657,773 A 8/1997 George

* cited by examiner

*Primary Examiner*—J. Casimer Jacyna

(57) ABSTRACT

The present invention provides a packaging device which allows for expulsion or delivery of its contents by means of the user's breath. The contents to be expelled are either pre-packaged, or else loaded from the front end (i.e., chewing gum, sugar sprinkles and other candy, confetti, beads, as well as fine powdered incense/fragrances and the like). The objects or contents may be launched into the air by blowing into the back of the tube, much like a pea-shooter. There are three primary features that distinguish it from a traditional pea-shooter. First, the objects are loaded from the front. Second, there is a barrier built in that prevents the contents from going the wrong way. Third, perforated sections are created at the "mouth" end, whereby the used end piece can be easily torn away by the previous user in order to create a fresh mouthpiece for the next user.

3 Claims, 7 Drawing Sheets

DISPOSABLE PACKAGING DEVICE THAT DISPENSES CONTENTS BY MOUTH/BREATH, WITH FRONT-END LOADING, A BUILT-IN BARRIER TO INSURE CONTENTS ARE DISPENSED ONLY IN APPROPRIATE DIRECTION, AND TEAR-AWAY SECTIONS OF THE MOUTHPIECE

CROSS-REFERENCE TO RELATED APPLICATIONS

Not applicable.

STATEMENT REGARDING FEDERALLY SPONSORED RESEARCH OR DEVELOPMENT

None.

REFERENCE TO MICROFICHE APPENDIX

Not applicable.

BACKGROUND OF THE INVENTION

1. Field(s) of the Invention

This invention relates to a packaging device or toy where the contents are expelled or delivered by means of the user's breath using a mouthpiece with detachable, perforated end pieces to safely permit multiple users.

2. Description of Related Art

Pea-shooters have long been popular with children (and a fair number of "adults"). One of the problems has been the tendency of children to attempt to take a deep breath with the pea-shooter in or near the mouth just before blowing into the pea-shooter, creating a very real risk of inhaling its contents and choking. Problems of spreading disease through contact with each other's saliva and oropharyngeal water droplets and fluids continue to exist with such toys, as children tend to share the same toy.

Finely ground, fragrant powders and incense can also be delivered with such a device, again with the same concern about inhaling the packaged powder the wrong way. Being able to keep such powders intact in the right quantify until needed, and then to "spray" them with a simple puff of one's own breath and then dispose of the biodegradable package would be convenient, commercially desirable, and would eliminate the use of potentially harmful aerosols.

An example of a pea-shooter that addressed a narrow improvement with a specific projectile manufactured for the invention itself is found in U.S. Pat. No. 2,679,838 issued to Thompson. In Thompson's invention, a "bullet" was designed to fit uniformly within the core of the pea-shooter, and had fins to assure a straight path once expelled. The mouthpiece had a smaller lumen than the bullet's diameter and the diameter of the distal shaft of the pea-shooter. Consequently, the bullet could not inadvertently be inhaled by the child, and a button device just in front of the bullet held it in place until the user pressed the button after building up air pressure. The user was restricted to "bullets" fitting the configuration of Thompson's invention. Smaller objects still created the risk of inadvertent inhalation and choking. Also, the end of the mouthpiece was not detachable and disposable, creating a risk to other users of the same toy. In Thompson's invention, air pressure was built up by a button that was compressed with a finger until released. For any smaller projectile or contents, the button would be inadequate to "hold" the projectile or contents in place until sufficient pressure built up.

A closer invention to the current application is found U.S. Pat. No. 1,491,809 issued to Macchia. Macchia's invention was a combination toy horn and dispenser of confetti, wherein the confetti was prepackaged and held in place by a tissue paper closure pasted over the end. Once the confetti was discharged by blowing into the horn, the "horn" could not be repackaged by confetti or other materials, but would still serve as a noise maker. Macchia's invention did not address spread of disease by water droplet/saliva contact with multiple users.

Another "confetti launching" device of more recent vintage (1997) is found in U.S. Pat. No. 5,624.295 issued to Watkins. There, the inventor came up with a long, hollow wand loaded at the end with pre-packed confetti that fit snugly, but would be released when the user snapped the wand overhead, the mechanism of projection/release being the centrifugal force created by the arc-type movement. In granting a patent to Watkins, the US PTO, noted the prior relevant Macchia invention. Watkins' invention was limited to dispensing confetti.

The idea of perforations in a mouthpiece are not new, and are found in various designs for cigarette filters. However, those perforations are designed to allow venting of exterior air into the mix of tobacco combustion; not to permit tearing away of the proximal end of the filter to permit multiple users while limiting risk of spread of disease by saliva or water droplet contamination. See, for example, U.S. Pat. No. 4,646,762 issued to Riehl. One of the beneficial applications of the current invention is that it may be applied to cigarette filters or cigarette holders to permit sharing without spread of disease. E.g., when somebody wants a "drag" of another's cigarette.

In U.S. Pat. No. 5,657,773 issued to George, a rectangular strip of deformable material was adhered to at the mouth-end, resulting in a uniform cylinder when the paper was rolled. A secondary benefit of his invention was that it created a barrier that prevented the cylinder's actual contents form being inhaled, but allowed the smoke to pass through. A similar barrier is created in the current invention in part for purposes of avoiding the contents from going the wrong way. George's invention did not apply to air being blown out (as opposed to sucked in), nor did it address the problem created by multiple users e.g., the mouth-end of the cylinder was not perforated or detachable.

BRIEF SUMMARY OF THE INVENTION

The present invention provides a packaging device which allows for expulsion or delivery of its contents by means of the user's breath. The contents to be expelled are either pre-packaged, or else loaded from the front end (i.e., chewing gum, sugar sprinkles and other candy, confetti, beads, as well as fine powdered incense/fragrances and the like. The objects or contents may be launched into the air by blowing into the back of the tube, much like a pea-shooter. In addition to the pre-packaging features of this invention, there are three primary features that distinguish it from a traditional pea-shooter. First, the objects are loaded from the front. Second, there is a barrier built in by design that prevents the contents from going the wrong way. Both of these features avoid a choking hazard to the user, particularly children. Third, in a further embodiment of the invention, perforated sections are created at the "mouth" end, whereby the used end piece can be easily torn away by the previous user in order to create a fresh mouthpiece for the next user, thereby avoiding unsanitary spread of disease from the other's saliva. Further, the "plug" at the end for finer powders or prepackaged items consists of a twist of the thin paper holding the contents, allowing for repackaging by the user after it unravels and the contents are expelled. This thin "skin" is also adjustable, allowing for changes in the chamber length to permit different quantities or sizes of materials to be "loaded" or packaged. In another embodiment of the invention, the inner cylinder is designed to create a "funnel" effect whereby the air pressure from the user's breath builds up to create greater propulsion of the package's contents.

DETAILED DESCRIPTION OF THE INVENTION

Figure 3:
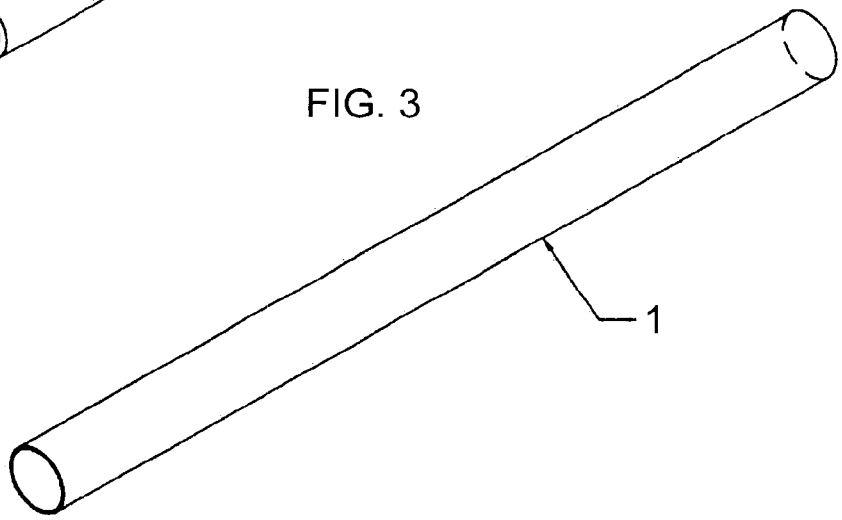
FIG. 3 is an illustration of the outer sleeve.
Figure 7:
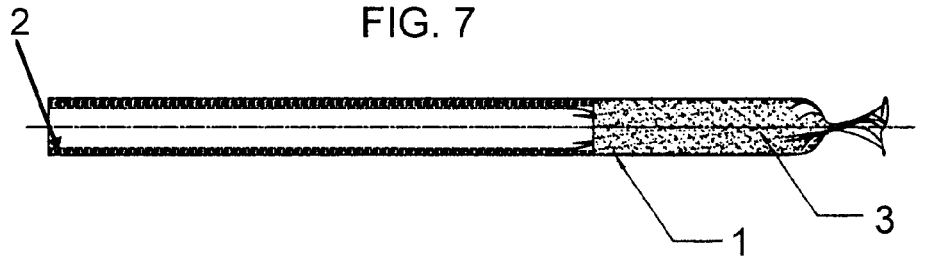
FIG. 7 is a side view of the device showing how the external sleeve can be twisted at the end to prevent the contained material from falling out until expelled by the user's breath.

FIG. 3 represents the outer cylindrical shell or sleeve 1 which is composed of cigarette paper or, in some embodiments, foil or plastic. This material typically will be capable of being easily torn manually and will generally be relatively airtight, particularly when used with an inner core that has perforations to facilitate the "mouth" end being torn away when multiple users are involved. The outer sleeve thus serves the function of enabling the user to blow out the contents, since the perforations of the inner core would otherwise diminish the build up of air pressure. This outer shell will also be capable of being readily twisted at its distal end to contain packaged items in chamber 3, as illustrated in FIG. 7.

Figure 1:
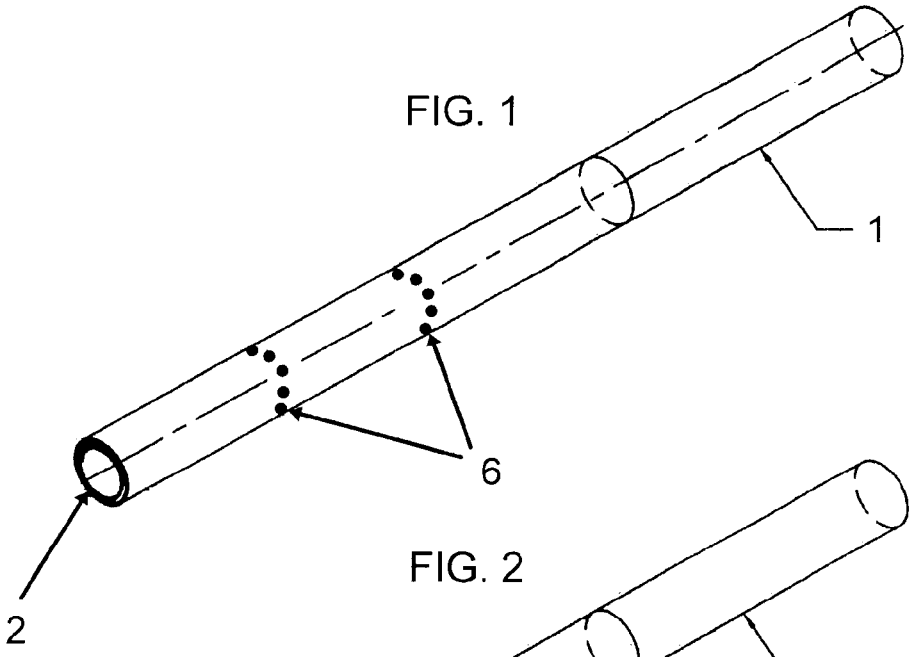
FIG. 1 is a general overview of the device, showing the two main parts of the outer and inner tubes.
Figure 4:
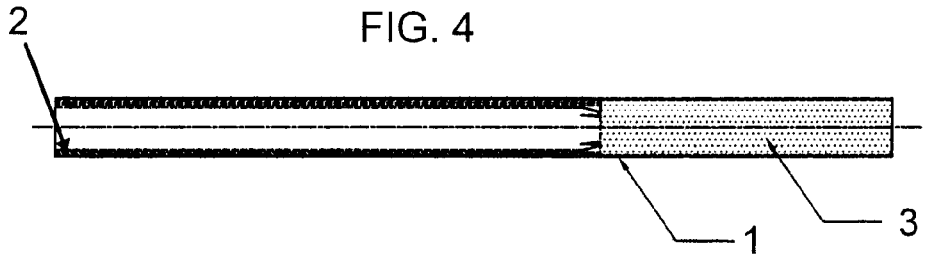
FIG. 4 is a side view of the device when loaded with something that only needs a partial barrier to prevent going the wrong way.

FIG. 1 illustrates on ¾ view, and FIG. 4 on side cutaway view, the two main parts of the invention. The inner part 2, usually spiraled in various configurations before being released within outer shell 1, gives the outer shell support to create a cylindrical shape. It will usually be made of paper which is flexible, strong and durable, but moldable with a forceful pinch by the user. It may also be made of plastic. The outer shell 1 fits snugly over inner core 2, but may still be slid in or out to change the size of the packing chamber 3.

Figure 2:
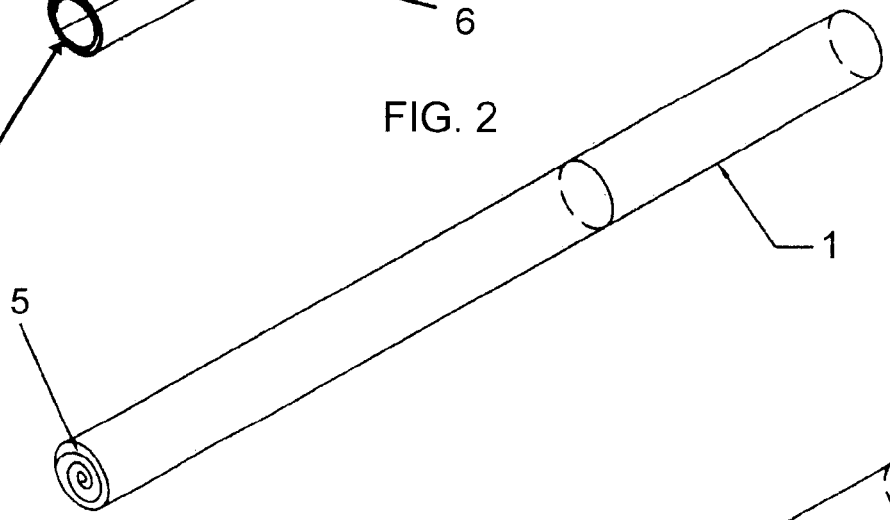
FIG. 2 is similar to FIG. 1, but illustrates how the opening of the inner tube can be narrowed.
Figure 6:
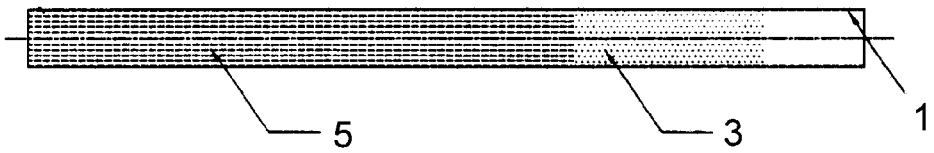
FIG. 6 is a side view of the device illustrated in FIG. 2 wherein the inner tube is rolled tightly to the center to provide a small opening.
Figure 20:
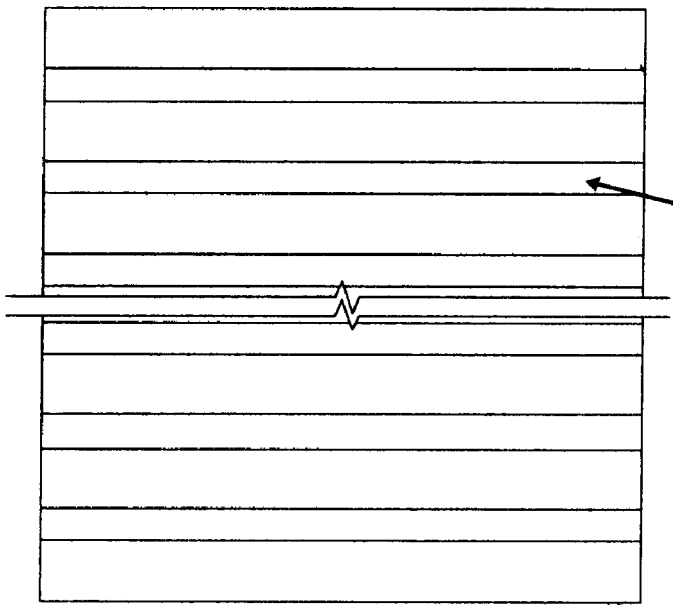
FIG. 20 is an illustration of the inner tube before being rolled, with laminated parallel strips to allow for air flow when the inner tube is tightly rolled to a narrow lumen, as further illustrated in FIG. 6 from side view.
Figure 21:
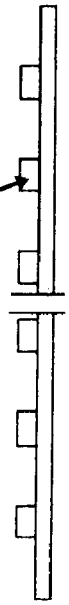
FIG. 21 is an illustration showing the ends of the laminated strips of FIG. 21 serving as spacers for the tightly rolled inner tube.
Figure 22:
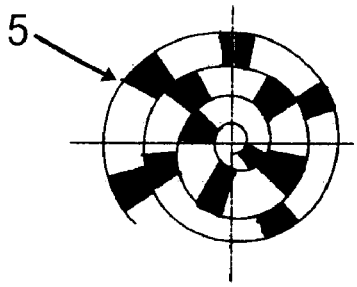
FIG. 22 is an illustration showing the ends of the laminated strips of FIG. 21 serving as spacers for the tightly rolled inner tube.

FIG. 2 illustrates on ¾ view, and FIG. 6 on side cutaway view, a variation wherein the inner core 2 has a more extensive spiral plug 5 filling to the center, thereby providing protection from inhalation of finer packaged powders or similar items. Detail of the tightly configured spiral plug 5 is contained in FIGS. 20, 21, and 22.

Figure 5:
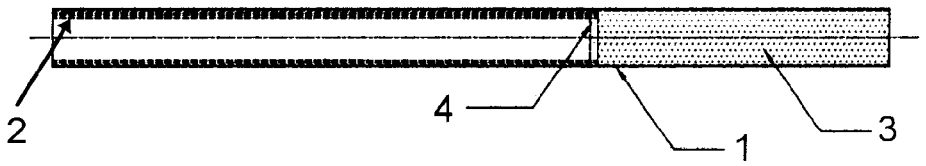
FIG. 5 is a side view of the device when loaded with particulate material wherein a one-way plug is used to prevent the particulate material from going the wrong way.
Figure 8:
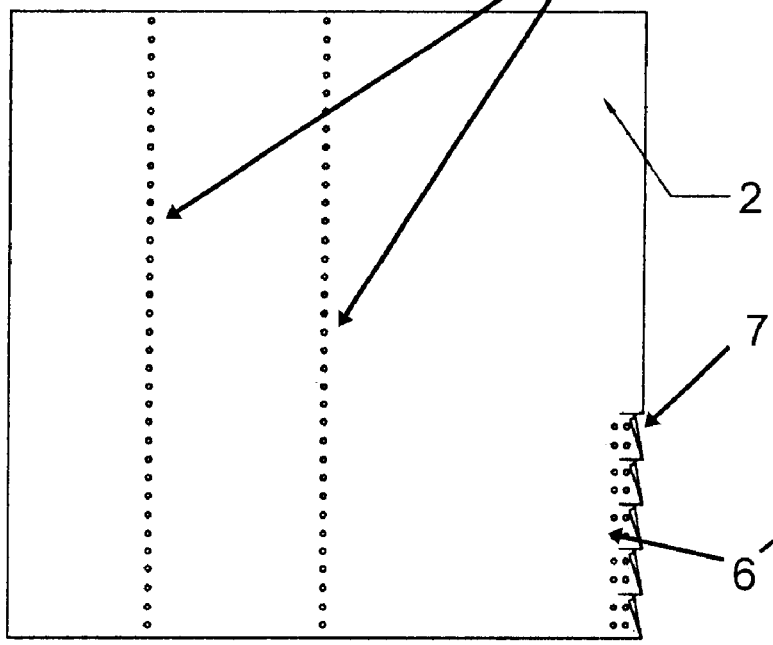
FIG. 8 is an illustration of the inner tube before being rolled, showing the perforations that will create detachable sections of the mouthpiece, cuts and folds on the distal edge of the paper that will form a barrier when the paper is rolled, and extra perforations that will allow for the user to smell the contents of the package before deciding to use it.
Figure 9:
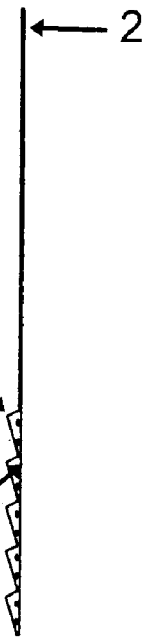
FIG. 9 is a side view of the distal edge of FIG. 8 illustrating how the cuts and folds look before the paper is rolled.
Figure 10:
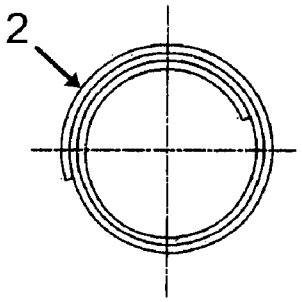
FIG. 10 is an end view of the inner tube without any barrier or plug.
Figure 11:
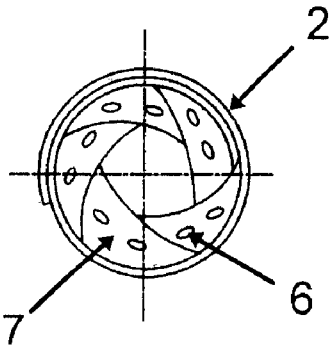
FIG. 11 is an end view of the inner tube illustrating what FIG. 8 would look like after being rolled into its cylindrical shape (e.g., what the barrier looks like when completed).
Figure 12:
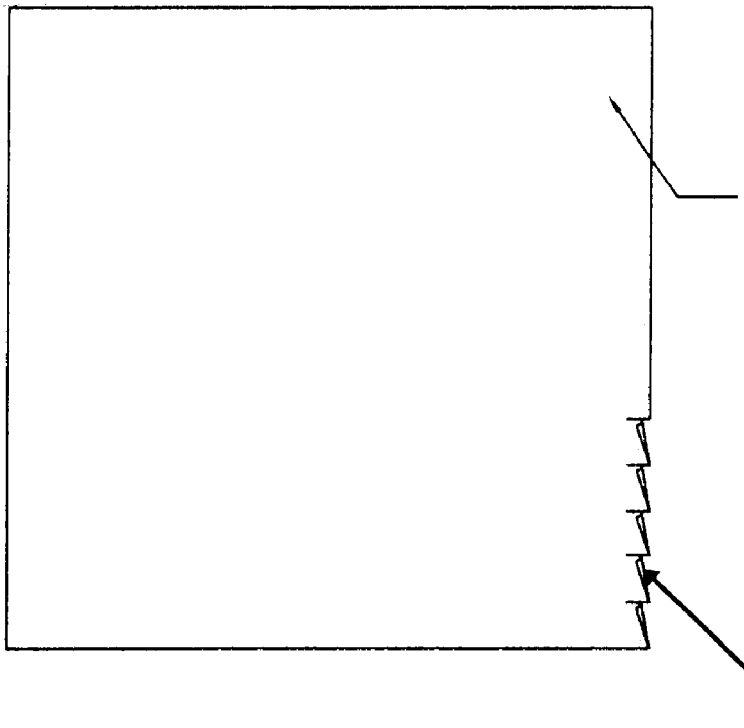
FIG. 12 is a an illustration of the inner tube before being rolled, showing only the cuts and folds on the distal edge of the paper that will form a barrier when the paper is rolled.
Figure 13:
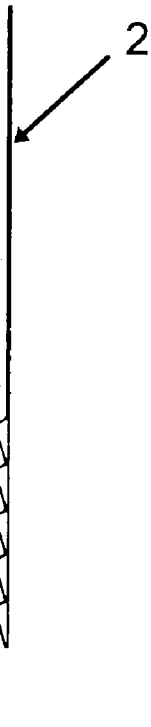
FIG. 13 is a side view of the distal edge of FIG. 12 illustrating the cuts and folds that will serve to create the inner barrier.
Figure 14:
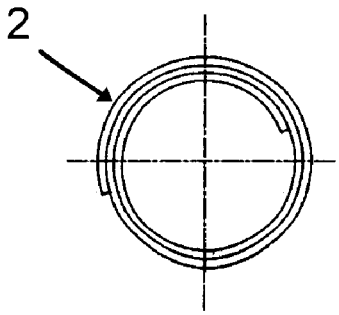
FIG. 14 is an end view of the inner tube without any barrier or plug.
Figure 15:
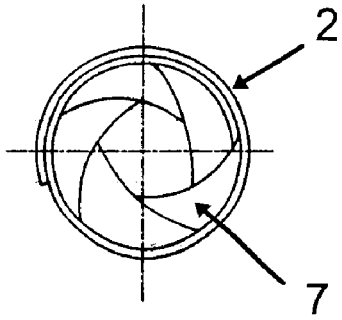
FIG. 15 is an end view of the inner tube illustrating what FIG. 12 would look like after being rolled.
Figure 16:
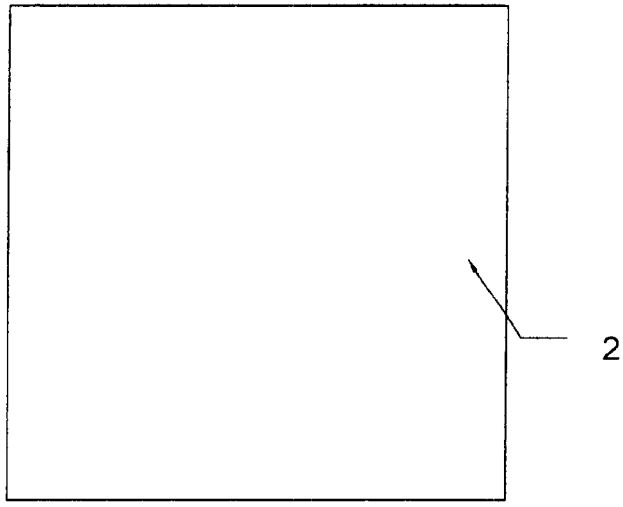
FIG. 16 is a view of the sheet of paper (or other material) before being rolled into the inner tube.
Figure 17:
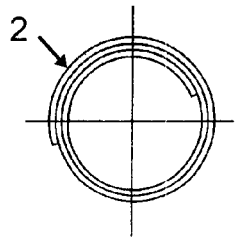
FIG. 17 is an end view of the inner tube without any barrier or plug.
Figure 18:
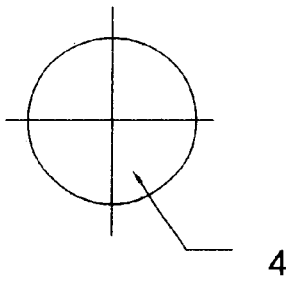
FIG. 18 is a paper disk (as shown on FIG. 5) that will serve as a one-way plug because it's diameter will equal the inside diameter of the outer shell, and will be pressed against the distal end of the inner tube before packing with powder of particulate material in the packaging chamber of the outer shell which extends distally beyond the inner tube.
Figure 19:
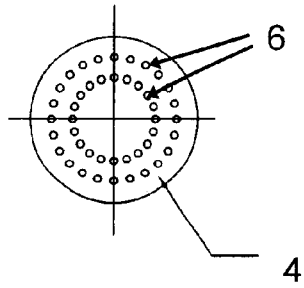
FIG. 19 is a disk configured and placed identically to FIG. 18, except that FIG. 19 has small perforations that will permit the odor of the packaged contents to be smelled by the consumer, but will not allow the particulate matter to pass the wrong way.

FIG. 5 is the same as FIG. 4, except for the addition of plug 4, which prevents the contents of the device from being expelled or inhaled in the wrong direction. The thickness and opening of the plug will vary depending on the nature of the materials packed within the invention. For example, FIGS. 12, 13 and 15 show a plug created from cuts/folds 7 on the distal edge of inner core 2 before it is rolled or spiraled. FIG. 12 is looking at paper 2 flat, and FIG. 13 is looking at paper 2 from its distal edge, both showing cuts/folds 7. The plug is created when paper 2 is rolled or spiraled, causing the cuts/folds 7 to overlap, as shown in FIG. 15 on end view. FIG. 14 merely contrasts an end view of the device without any plug. FIGS. 8, 9 and 11 are similar to the plug created in FIGS. 12, 13 and 15, except that perforations 6 have been added to inner core 2. The linear perforations from top to bottom will create sections of inner core 2 that can readily be torn away with multiple users, or when necessary to increase the capacity of chamber 3 by sliding distally outer shell 1. There are also perforations 6 added to the plug in FIGS. 8, 9 and 11, to provide for different air flow. FIGS. 16, 17, 18 and 19 illustrate how one-way plugs 4 that give way under air pressure are configured. FIG. 17, in this instance, represents the seat that the give-way discs 4 will be pressed against when chamber 3 is packed. Discs 4 will be larger in diameter than the lumen of inner core 2, but slightly smaller than the lumen of outer shell 1. FIG. 18 illustrates a give-way disc 4 that is solid without perforations, providing for the greatest expulsive force, and full protection for the packaged contents going the wrong way. FIG. 19 is the same give-way disc 4 with perforations. The primary purpose of the perforations in this instance is for the user to be able to smell the aroma of the packaged contents without opening the package. For example, if powdered incense is to be dispensed in the air by blowing into the packaging device, the potential user can sniff the open end and determine the nature of the aroma.

Figure 23:
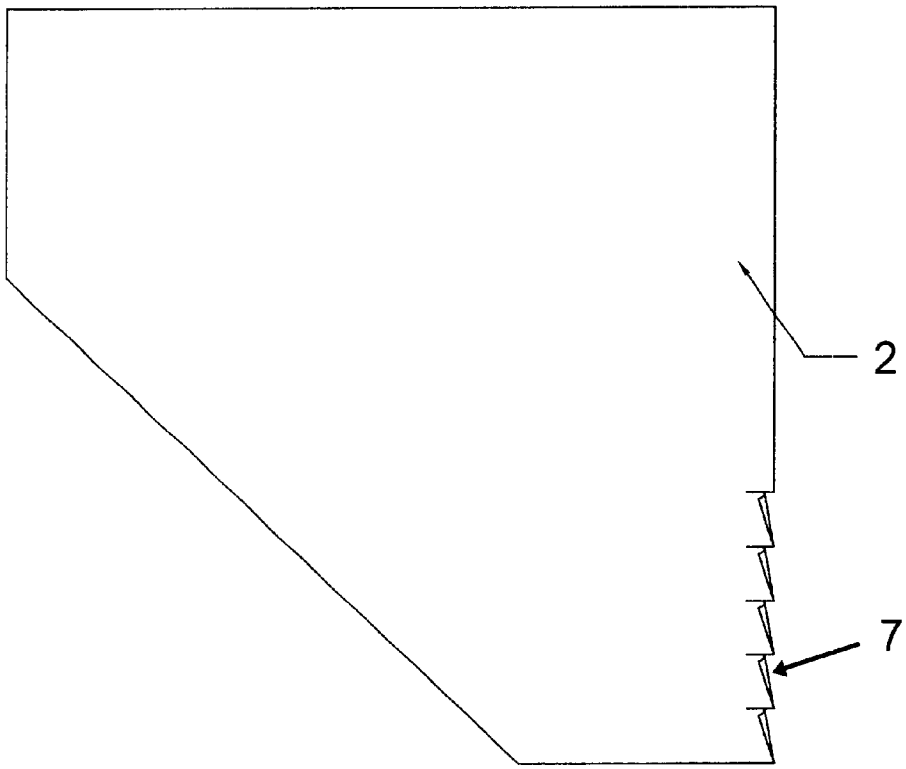
FIG. 23 is an illustration of the inner tube, but cut and designed to create a telescopic or funnel effect so as to created a jet of pressure at the distal end, which will be the most narrow. The cuts and folds on FIG. 23 do not extend the full edge of the paper based upon the smallest opening being at the point where the barrier will be created.
Figure 24:
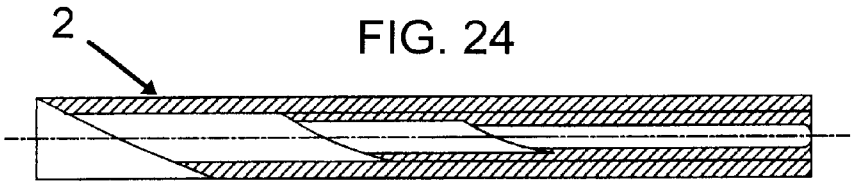
FIG. 24 is an illustration of FIG. 23 after being rolled, creating the spiraled, telescopic funnel shape.

FIGS. 23 and 24 illustrate how inner core 2 can be spiraled to create a funnel/jet effect to develop greater buildup of air pressure before the packaged material is expelled.

What I claim as my invention is:

1. A packaging device which allows a variety of contents to be expelled or delivered by the user's breath, comprising:

(a) an outer hollow elongated tube;

(b) an inner tube, which fits within the outer tube and is of sufficient stiffness to maintain a cylindrical shape;

(c) said inner tube having a barrier or plug to prevent the contents from entering the mouthpiece end;

(d) said tubes defining a mouthpiece end and a distal end, said tubes being perforated at the mouthpiece end to make removable sections which may be torn away after usage;

(e) said tubes being made of sufficiently malleable material to allow reshaping of the mouthpiece end after a removable section is torn away.

2. The packaging device of claim 1 whereby the contents are loaded and reloaded from the distal end by the user.

3. The packaging device of claim 1 whereby packaged contents include small parts or powder, wherein the outer shell is sufficiently longer than the inner tube to allow for containment of contents and the twisting of the outer shell to the correct tension to retain the contents until expelled by breath.

* * * * *